US007231708B1

(12) United States Patent
Chandler et al.

(10) Patent No.: US 7,231,708 B1
(45) Date of Patent: Jun. 19, 2007

(54) METHOD FOR MARKING FUSES

(76) Inventors: R. Dennis Chandler, 5453 Stephenson La., Corydon, IN (US) 47112-7452; Raymond Leblond, 243-16 52nd Ave., Douglaston, NY (US) 11362

( * ) Notice: Subject to any disclaimer, the term of this patent is extended or adjusted under 35 U.S.C. 154(b) by 423 days.

(21) Appl. No.: 10/930,441

(22) Filed: Aug. 31, 2004

Related U.S. Application Data

(60) Provisional application No. 60/502,100, filed on Sep. 11, 2003.

(51) Int. Cl.
*H01H 69/02* (2006.01)

(52) U.S. Cl. ..... 29/623; 29/417; 29/605; 29/756; 29/757; 337/186; 337/227; 337/231; 337/248

(58) Field of Classification Search ..... 29/623, 29/417, 605, 756, 757; 337/186, 227, 231, 337/248
See application file for complete search history.

(56) References Cited

U.S. PATENT DOCUMENTS

| | | | |
|---|---|---|---|
| 1,667,824 | A | 5/1928 | Richey |
| 1,856,676 | A | 5/1932 | Weston |
| 3,659,252 | A | 4/1972 | Brown |
| 4,023,264 | A | 5/1977 | Schmidt, Jr. et al. |
| 4,158,746 | A | 6/1979 | Taylor et al. |
| 4,385,281 | A | 5/1983 | McAlear et al. |
| 4,460,887 | A | 7/1984 | McAlear et al. |
| 4,511,875 | A | 4/1985 | Arikawa |
| 4,528,420 | A | 7/1985 | Kish et al. |
| 5,592,598 | A | 1/1997 | Yamrom |
| 5,736,919 | A | 4/1998 | Reeder |
| 5,874,884 | A | 2/1999 | Hull et al. |
| 5,974,661 | A | 11/1999 | Neuhalfen |

FOREIGN PATENT DOCUMENTS

| | | | |
|---|---|---|---|
| GB | 2 354 645 | A | 3/2001 |
| JP | 4003194 | A2 | 1/1992 |
| JP | 4230972 | A2 | 8/1992 |
| JP | 10-064403 | * | 3/1998 |

* cited by examiner

*Primary Examiner*—A. Dexter Tugbang
*Assistant Examiner*—Tim Phan
(74) *Attorney, Agent, or Firm*—Stites & Harbison, PLLC; David W. Nagle, Jr.

(57) ABSTRACT

In a method for marking a fuse in order to allow for the rapid visual identification of certain characteristics of that fuse, the fuse is provided with: a first color-coded visual indicia indicative of an amperage rating of the fuse; a second color-coded visual indicia indicative of an action value of the fuse; and/or a third color-coded visual indicia indicative of a voltage rating of the fuse.

8 Claims, 3 Drawing Sheets

| Color | Value |
|---|---|
| BLACK | 0 |
| BROWN | 1 |
| RED | 2 |
| ORANGE | 3 |
| YELLOW | 4 |
| GREEN | 5 |
| BLUE | 6 |
| VIOLET | 7 |
| GRAY | 8 |
| WHITE | 9 |
| GOLD | DENOMINATOR |

FIG. 1

| | | | |
|---|---|---|---|
| SLOW-BLOW | ONE GOLD BAND | | |
| FAST-ACTING | ONE SILVER BAND | | |
| CURRENT-LIMITING | ONE BLACK BAND | | |
| DUAL-ELEMENT | ONE GOLD AND ONE SILVER BAND | | |
| AMP-TRAP | TWO GOLD BANDS | | |
| TIME-DELAY | TWO SILVER BANDS | | |
| RECTIFIER-ONE WAY | TWO BLACK BANDS | | |

FIG. 2

METHOD FOR MARKING FUSES

CROSS-REFERENCE TO RELATED APPLICATIONS

The present application claims priority to U.S. Provisional Application Ser. No. 60/502,100 filed Sep. 11, 2003, the entire disclosure of which is incorporated herein by reference.

BACKGROUND OF THE INVENTION

The present invention is a method for marking fuses.

In maintaining various electrical equipment, installation and/or replacement of fuses is an important task. Each fuse has a specified amperage rating, voltage rating, and action value. For example, for glass cartridge-type fuses, these values are usually stamped onto one of the metal end caps of the fuse, and therefore, such values are often difficult to read. It is critical that the appropriate fuse be used and installed to prevent damage to associated electric and/or electronic equipment.

It would therefore be desirable to provide a method for marking fuses that allows for the rapid visual identification of the amperage rating, voltage rating, and/or action value of a particular fuse.

SUMMARY OF THE INVENTION

The present invention is a method for marking fuses, for example, glass cartridge-type fuses, in order to allow for the rapid visual identification of the certain characteristics of a fuse—amperage rating, voltage rating, and/or action value.

The method of the present invention is preferably based on the universal color coding system used for resistor values, with each numerical digit being represented by a predetermined color. Color-coded visual indicia are then applied to the fuse in order to allow for rapid visual identification of the amperage rating, voltage rating, and/or action value of the fuse.

With respect to the amperage rating, in one exemplary implementation of the present invention, a fuse is provided with one or more bands that are appropriately colored to indicate the amperage rating of the fuse, bands that are preferably located at a first end of the fuse adjacent one of the end caps, each band representing a numerical digit of the amperage rating. Furthermore, at the opposite end of the fuse near the second end cap, the fuse is provided with a one or more additional color bands that indicate the action value of the fuse. Lastly, the voltage rating of a fuse may also be indicated by providing the fuse with a series of colored dots arranged in a substantially vertical line, each colored dot representing a numerical digit of the voltage rating.

DESCRIPTION OF THE DRAWINGS

FIG. 1 is a table illustrating a color coding system for indicating the amperage and voltage ratings of a fuse in accordance with the method of the present invention, which is based on the universal color coding system used for resistor values;

FIG. 2 is a table illustrating a color coding system for indicating the action value of a fuse in accordance with the method of the present invention;

DETAILED DESCRIPTION OF THE INVENTION

The present invention is a method for marking fuses, for example, glass cartridge-type fuses, in order to allow for the rapid visual identification of the certain characteristics of a fuse—amperage rating, voltage rating, and/or action value.

The method of the present invention is preferably based on the universal color coding system used for resistor values. As illustrated in the table of FIG. 1, each numerical digit is represented by a predetermined color. Color-coded visual indicia are then applied to the fuse in order to allow for rapid visual identification of the amperage rating, voltage rating, and/or action value of the fuse.

Figure 3:
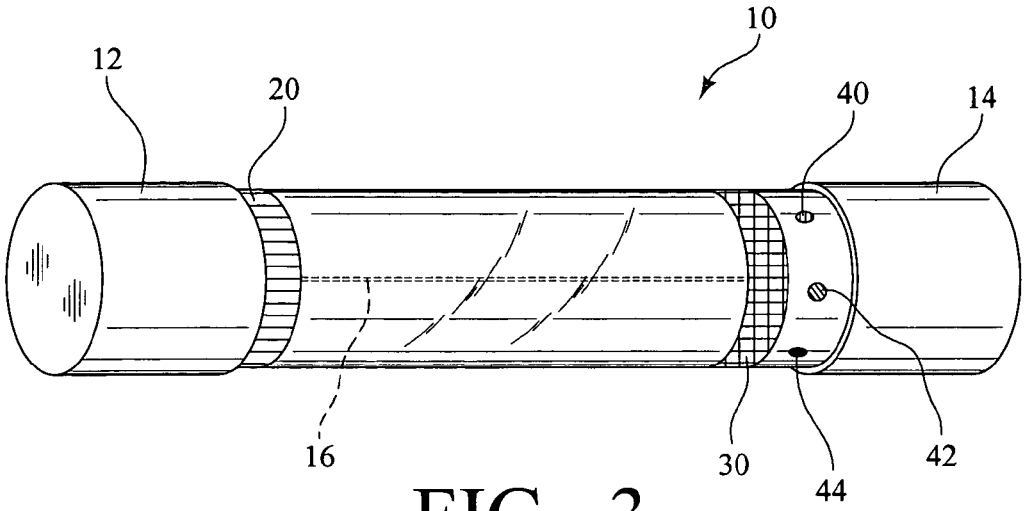
FIG. 3 is a perspective view of an exemplary fuse employing the method of the present invention.

With respect to the amperage rating, in one exemplary implementation of the present invention, a fuse is provided with a band that is appropriately colored to indicate the amperage rating of the fuse, a band that is preferably located at a first end of the fuse adjacent one of the end caps. For example, FIG. 3 is a perspective view of an exemplary fuse 10, which includes left and right end caps 12, 14, with a filament 16 that extends the length of the fuse 10 between the end caps 12, 14. This fuse 10 is provided with a blue band 20 near the left end cap 12, indicating an amperage rating of six amps.

Figure 4:
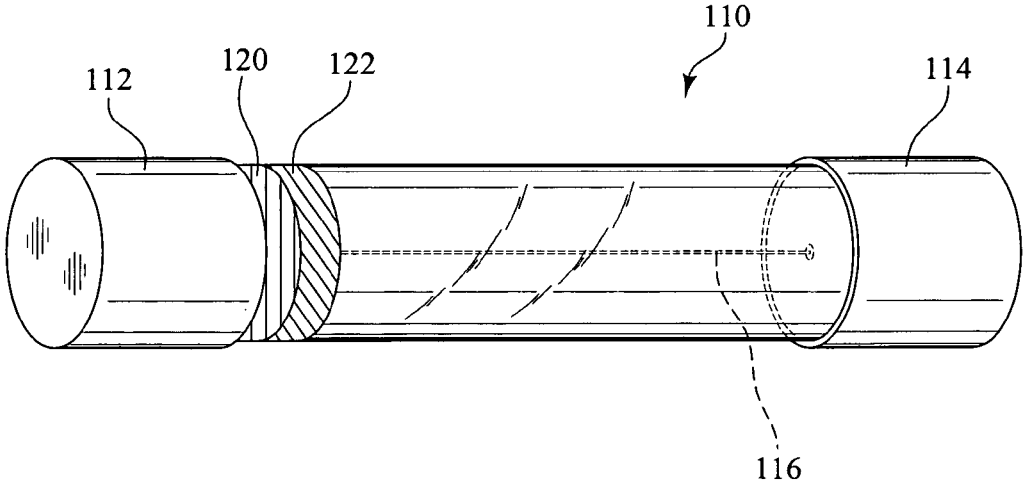
FIG. 4 is a perspective view of another exemplary fuse employing the method of the present invention.

If the amperage rating has a double-digit value, two color bands may be placed side-by-side, each representing a numerical digit. For example, FIG. 4 is a perspective view of another exemplary fuse 110, which includes left and right end caps 112, 114, with a filament 116 that extends the length of the fuse 110 between the end caps 112, 114. This fuse 110 is provided with a red band 120 and a green band 122 that are placed side-by-side near the left end cap 112, indicating an amperage rating of twenty-five amps.

Figure 5:
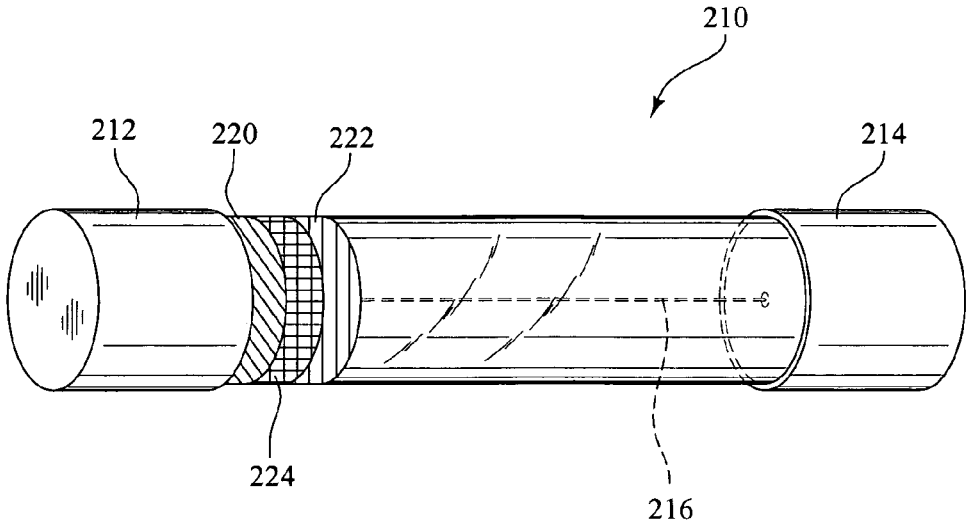
FIG. 5 is a perspective view of yet another exemplary fuse employing the method of the present invention.

Furthermore, if the amperage rating has a fractional value, two color bands may also be used, but are separated by a neutral band indicative of the fractional relationship between the other two bands. For example, FIG. 5 is a perspective view of yet another exemplary fuse 210, which includes left and right end caps 212, 214, with a filament 216 that extends the length of the fuse 210 between the end caps 212, 214. This fuse 210 is provided with a yellow band 220 and a red band 222 that are placed near the left end cap 212, but are separated by a neutral band 224 (i.e., a gold band), thus indicating an amperage rating of one-half amp.

Again, the color coding system described in the above examples is based on the universal color coding system used for resistor values. However, other color coding systems or schemes could also be employed without departing from the spirit and scope of the present invention.

Referring again to the exemplary fuse 10 illustrated in FIG. 3, at the opposite end of the fuse 10 near the right end cap 14, there is a second color band 30 that indicates the action value of the fuse, according to a predetermined table. To ensure that this second color band 30 is not confused with the amperage band, it is preferred that the colors indicative of the action value of the fuse be distinguishable from those indicating amperage.

Accordingly, FIG. 2 is a table illustrating a color coding system for indicating the action value of a fuse in accordance with the method of the present invention, a system that uses the colors gold, silver, and black, or combinations thereof. In any event, the color band 30 of the fuse 10 illustrated in FIG. 3 is gold in color, which in this example, indicates a "slow-blow" action. As illustrated in the table of FIG. 2, other actions that may be represented by appropriate color bands include, but are not limited to: fast-acting, current-limiting, dual-element, amp-trap, time-delay, and rectifier-one way.

Lastly, the voltage rating of a fuse may also be indicated in accordance with the color coding system of the present invention. Referring still to the exemplary fuse 10 illustrated in FIG. 3, the fuse 10 is marked with a series of colored dots 40, 42, 44. In this example, the colored dots 40, 42, 44 are arranged in a substantially vertical line located between the color band 30 indicative of action value and the right end cap 14 and include a red dot 40, a green dot 42, and a black dot 44, thus indicating a voltage rating of 250 volts. In other words, the voltage rating is read top to bottom, each colored dot 40, 42, 44 representing a numerical digit, much like each color band represents a numerical digit.

Figure 6:
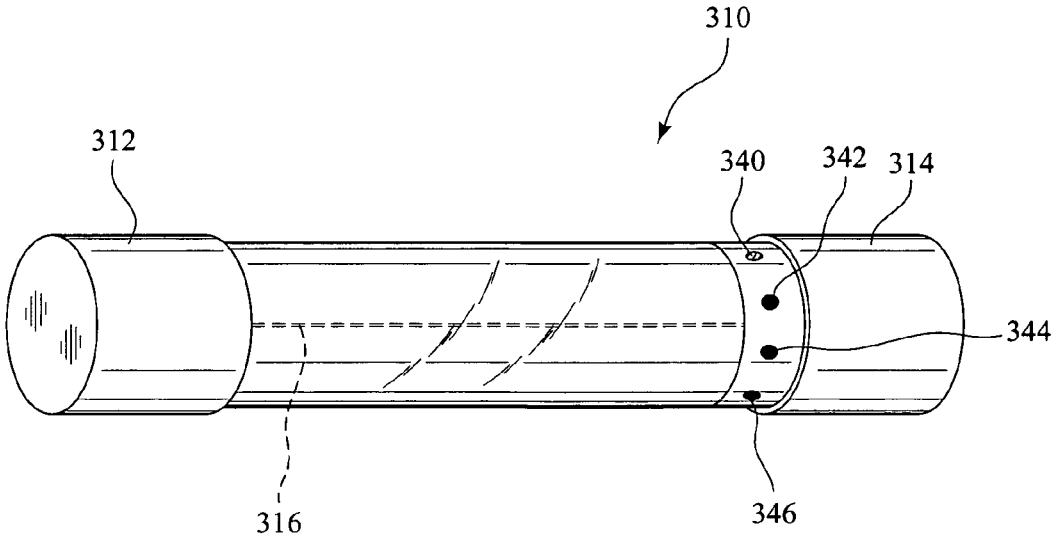
FIG. 6 is a perspective view of still yet another exemplary fuse employing the method of the present invention.

FIG. 6 is a perspective view of still yet another exemplary fuse 310, which includes left and right end caps 312, 314, with a filament 316 that extends the length of the fuse 310 between the end caps 312, 314. Although this fuse 310 is not provided with any color bands representative of the amperage rating or action value, it is provided with a series of colored dots 340, 342, 344, 346 arranged in a substantially vertical line near the right end cap 314. The combination of a brown dot 340 and three black dots 342, 344, 346 represents a voltage rating of 1000 volts.

Thus, this method for marking fuses allows for the rapid visual identification of the certain characteristics of a fuse, including amperage rating, voltage rating, and/or action values.

It will be obvious to those skilled in the art that other modifications may be made to the invention as described herein without departing from the spirit and scope of the present invention.

The invention claimed is:

1. A method for marking a fuse in order to allow for the rapid visual identification of certain characteristics of that fuse, comprising the steps of:

providing said fuse with a first color-coded visual indicia at a first predetermined location indicative of an action value of said fuse; and providing said fuse with a second color-coded visual indicia at a second predetermined location indicative of one of an amperage rating of said fuse or a voltage rating of said fuse.

2. The method as recited in claim 1, and further comprising the step of:

providing said fuse with a third color-coded visual indicia at a third predetermined location indicative of the other of the amperage rating of said fuse or the voltage rating of said fuse.

3. The method as recited in claim 1, wherein said first color-coded visual indicia is a set of one or more color bands.

4. The method as recited in claim 1, wherein said second color-coded visual indicia is a set of one or more color bands.

5. The method as recited in claim 4, wherein each color band of said second color-coded visual indicia is representative of a numerical digit.

6. The method as recited in claim 1, wherein said second color-coded visual indicia is an array of colored dots, each such colored dot representing a numerical digit.

7. The method as recited in claim 6, wherein the colored dots are oriented in a substantially vertical line and positioned near an end cap of the fuse.

8. The method as recited in claim 1, wherein said fuse includes two end caps, said first predetermined location being near one of said end caps, and said second predetermined location being near a second of said end caps.

* * * * *